US010832640B1

(12) United States Patent
Hamilton

(10) Patent No.: US 10,832,640 B1
(45) Date of Patent: Nov. 10, 2020

(54) PLECTRUM FOR PLAYING A STRINGED INSTRUMENT AND METHOD OF USING SAME

(71) Applicant: Robert N. Hamilton, San Antonio, TX (US)

(72) Inventor: Robert N. Hamilton, San Antonio, TX (US)

( * ) Notice: Subject to any disclaimer, the term of this patent is extended or adjusted under 35 U.S.C. 154(b) by 0 days.

(21) Appl. No.: 16/692,826

(22) Filed: Nov. 22, 2019

Related U.S. Application Data

(60) Provisional application No. 62/771,893, filed on Nov. 27, 2018.

(51) Int. Cl.
*G10D 3/173* (2020.01)

(52) U.S. Cl.
CPC ..... *G10D 3/173* (2020.02)

(58) Field of Classification Search
CPC ..... G10D 3/173
See application file for complete search history.

(56) References Cited

U.S. PATENT DOCUMENTS 2,221,234 A * 11/1940 Frasier ..... G10D 3/173 84/322
2004/0159207 A1* 8/2004 Glyde ..... G10D 3/173 84/322

* cited by examiner

*Primary Examiner* — Kimberly R Lockett
(74) *Attorney, Agent, or Firm* — Taboada Law Firm, PLLC; John M. Taboada

(57) ABSTRACT

A method and apparatus for playing stringed instruments comprising: providing an apparatus comprising: a first member, wherein the first member is configured to strike or strum one or more strings of the stringed instrument; and a second member comprising: a main body coupled to and extending from a portion of the first member; a first handle extending from the main body and configured to be gripped between the thumb and index finger; and a second handle extending from the opposite side of the main body from the first handle and configured to be gripped with a middle, ring, and/or pinky finger; gripping the first handle between the thumb and index finger; gripping the second handle with the middle, ring, and/or pinky finger; and striking or strumming the strings of a stringed instrument with the first member to cause the strings to vibrate. Other embodiments are described and claimed.

15 Claims, 10 Drawing Sheets

PLECTRUM FOR PLAYING A STRINGED INSTRUMENT AND METHOD OF USING SAME

CROSS REFERENCE TO RELATED APPLICATIONS

This application claims the benefit of the filing date of U.S. Provisional Patent Application Ser. No. 62/771,893, filed on Nov. 27, 2018, entitled "Plectrum for Playing a Stringed Instrument and Method of Using Same," the entire disclosure of which is hereby incorporated by reference into the present disclosure.

BACKGROUND

The invention relates generally to a plectrum for playing a guitar or other stringed instrument. More particularly, the invention relates to an apparatus that provides a user with a plectrum having a secure grip and multiple playing surfaces for playing a guitar or other stringed instrument, and to a method for using the same.

SUMMARY

In one respect, disclosed is an apparatus for playing a stringed instrument comprising: a first member comprising a front surface, a point, a side, a front edge, a rear edge, and a back surface; and a second member comprising a main body, wherein the main body is coupled to and extends from a portion of the back surface of the first member; wherein the front surface, the point, the side, the front edge, the rear edge, and the back surface are configured to strike or strum one or more strings of the stringed instrument.

In another respect, disclosed is a method for playing a stringed instrument comprising: providing an apparatus comprising: a first member comprising a front surface, a point, a side, a front edge, a rear edge, and a back surface; and a second member comprising: a main body, wherein the main body is coupled to and extends from a portion of the back surface of the first member; a first handle extending from the main body, wherein the first handle is configured to be gripped between a thumb and an index finger; and a second handle extending from an opposite side of the main body from the first handle, wherein the second handle is configured to be gripped with a middle finger, a ring finger, and/or a pinky finger; wherein the front surface, the point, the side, the front edge, the rear edge, and the back surface are configured to strike or strum one or more strings of the stringed instrument; gripping the first handle between the thumb and the index finger; gripping the second handle with the middle finger, the ring finger, and/or pinky finger; and striking or strumming the one or more strings of the stringed instrument with the front surface, the point, the side, the front edge, the rear edge, and/or the back surface of the first member to cause the strings to vibrate.

Numerous additional embodiments are also possible.

BRIEF DESCRIPTION OF THE DRAWINGS

Other objects and advantages of the invention may become apparent upon reading the detailed description and upon reference to the accompanying drawings.

Figure 1A:
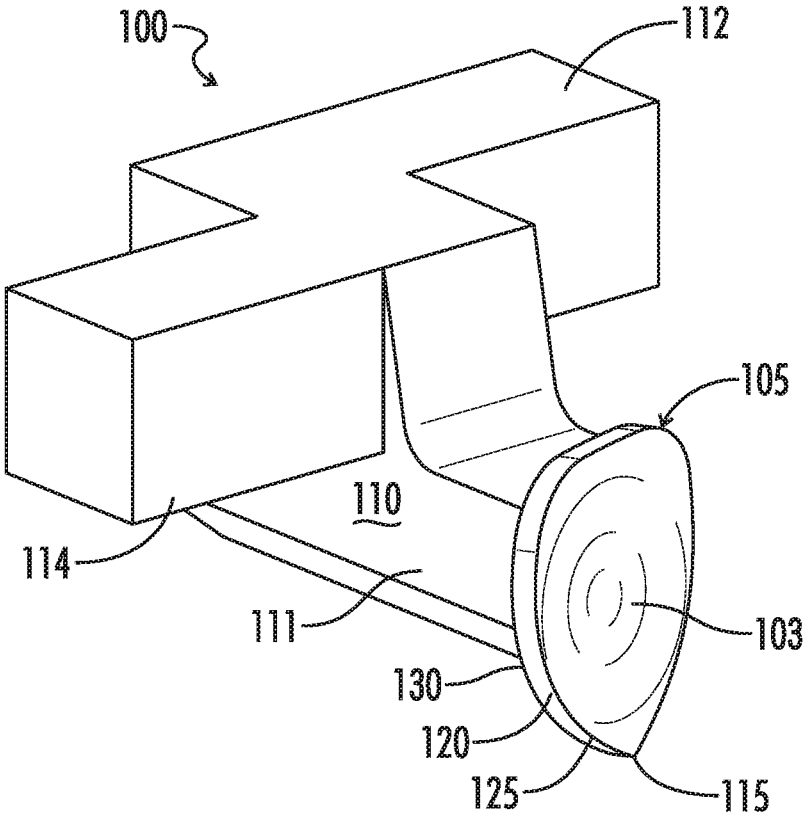
FIGS. 1A and 1B are front and rear, respectively, isometric illustrations of a stringed instrument plectrum, in accordance with some embodiments.

While the invention is subject to various modifications and alternative forms, specific embodiments thereof are shown by way of example in the drawings and the accompanying detailed description. It should be understood, however, that the drawings and detailed description are not intended to limit the invention to the particular embodiments. This disclosure is instead intended to cover all modifications, equivalents, and alternatives falling within the scope of the present invention as defined by the appended claims.

DETAILED DESCRIPTION

One or more embodiments of the invention are described below. It should be noted that these and any other embodiments are exemplary and are intended to be illustrative of the invention rather than limiting. While the invention is widely applicable to different types of systems, it would be impossible or impractical to include all of the possible embodiments and contexts of the invention in this disclosure. Upon reading this disclosure, many alternative embodiments of the present invention will be apparent to persons of ordinary skill in the art.

Plectrum for playing stringed instruments have been around for centuries. Early plectrums used various animal parts such as bone, tortoise shell, and stone. With modern day guitars came other plectrums with the most common being a triangular shaped flat celluloid pick first made by D'Andrea Picks back in 1922. For nearly 100 years most of the shapes and designs of guitar picks have not changed much. One of the biggest drawbacks of these flat, triangular picks is that the user does not have much of a grip and is unable to use the pick with as much force and control as desired. The embodiment described herein solves these problems and others by proposing a new plectrum for playing a stringed instrument and method of using same.

Figure 1B:
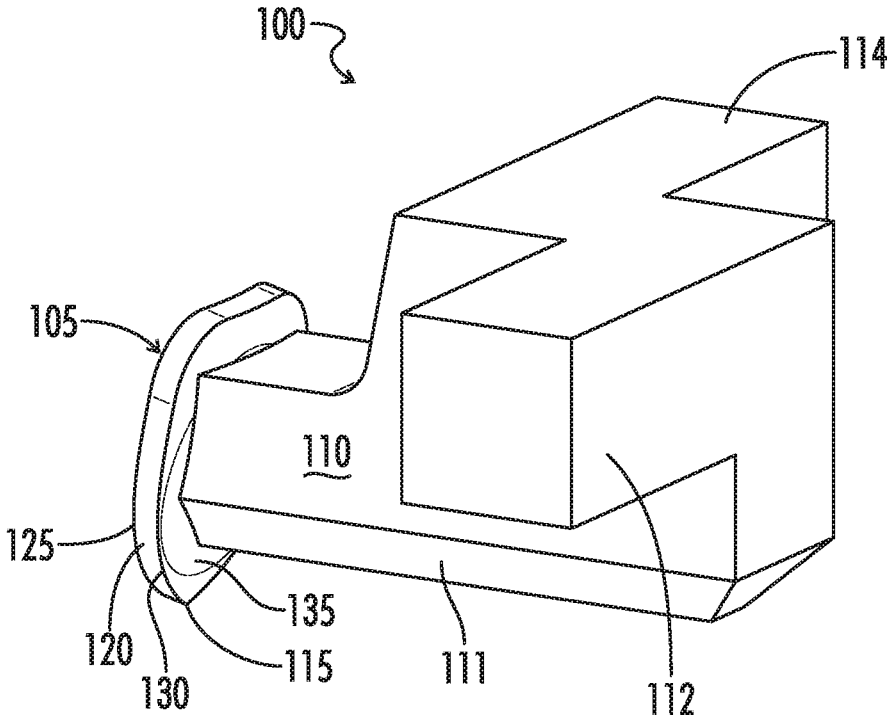

FIGS. 1A and 1B are front and rear, respectively, isometric illustrations of a stringed instrument plectrum, in accordance with some embodiments.

Figure 2A:
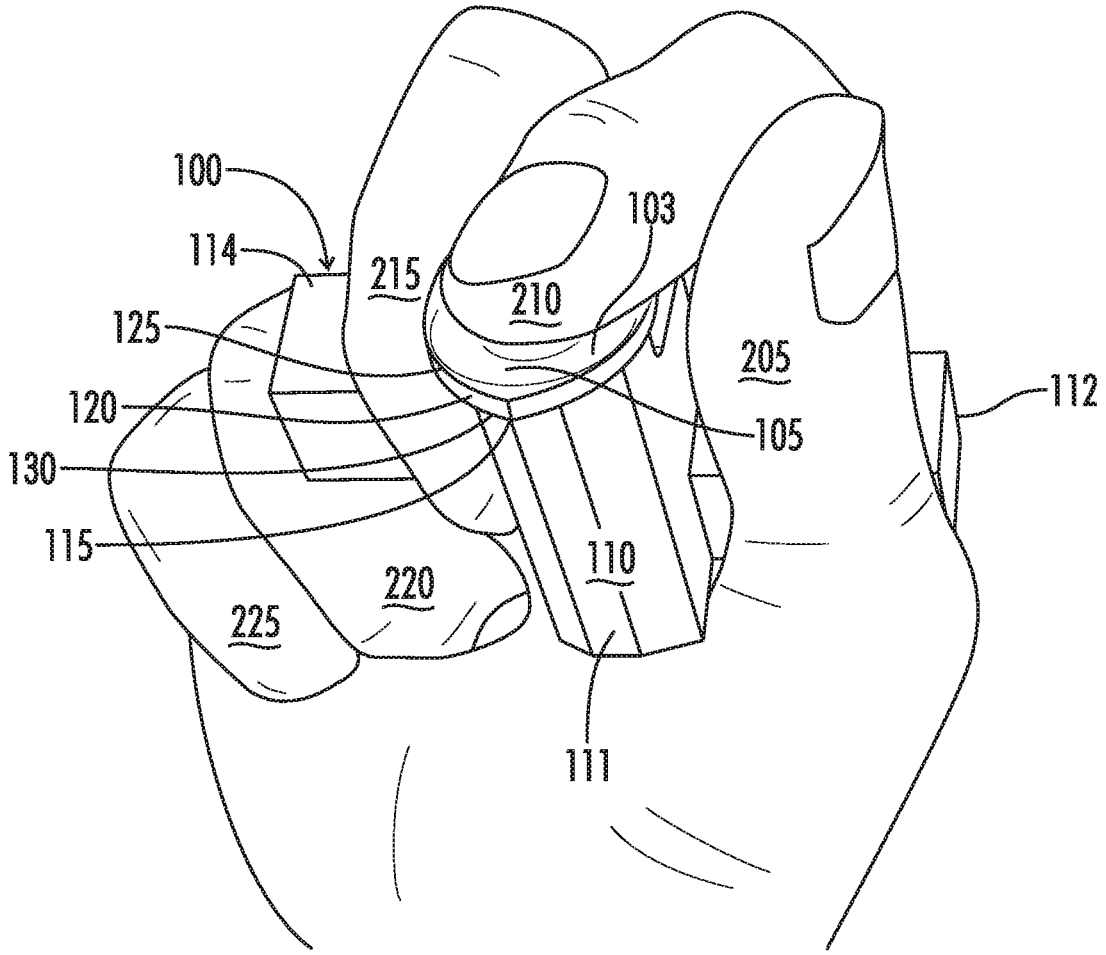
FIGS. 2A, 2B, and 2C are illustrations of the stringed instrument plectrum in a user's hand, in accordance with some embodiments.

In some embodiments, the stringed instrument plectrum apparatus 100 comprises a first member 105 and a second member 110 coupled to and extending substantially normal to a portion of a surface of a back side of the first member. The first member 105 comprising a front surface 103, a point 115, a side 120, a front edge 125, a back edge 130, and a back surface 135. The second member 110 comprises a main body 111, coupled to and extending from a portion of the back surface of the first member, and two handle members extending from opposite sides of the main body. The handles of the apparatus allow for a more secure grip of the first member compared to gripping a regular pick since the apparatus involves the use of the index finger valley, thenar, upper palm, and phalanx areas of the inside of the hand as opposed to a regular pick which is held with the thumb and index finger. The handles orient the side 120 of the first member to be the primary string playing or attack surface. The back and edges of the first member are also important playing surfaces. The first handle member 112 provides a grip between the thumb and index finger and the second handle 114 provides a grip between the middle finger, ring finger, and/or pinky finger and upper palm. The apparatus is sized so that a user playing a stringed instrument may grip the apparatus between the user's thumb and index finger and the middle finger and the upper palm as illustrated in FIG. 2A. In some alternative embodiments having a second handle 114 which extends further from the main body 111, the user may also use the middle finger, ring finger, and/or pinky finger to also grip the second handle member 114. The point 115, side 120, front edge 125, back edge 130, and back surface 135 of the first member 105 may be used to strike or strum one or more strings of a stringed instrument. The user may adjust the angle of attack and tighten or loosen the grip in order to accommodate tonal or dynamic variations.

In some embodiments, the first member 105 is formed of a monolithic piece of material, such as (but not limited to) plastic, metal, animal horn, animal bone, animal leather, wood, glass, and the like, all of which are well known in the art for their suitability for guitar pick material. The first member 105 may comprise a substantially flat plectrum style guitar pick or have a convex shape where the perimeter (formed from the side, front edge, and back edge of the first member) of the first member curves or extends away, i.e. outward, from the second member. The convex shaped first member may be formed by cutting out a triangularly shaped portion from a surface of a sphere or other structure having a convex shape portion. In some embodiments, the second member 110 is formed of a monolithic piece of material, such as (but not limited to) foam, metal, plastic, animal horn, animal bone, animal leather, wood, glass, and the like, all of which are well known in the art for their suitability for handle or grip material.

Alternatively, in some embodiments, the first member and second member are monolithically formed as an integral unit. In such an embodiment, the apparatus 100 is formed of a monolithic piece of rigid material, such as (but not limited to) metal, plastic, animal horn, animal bone, animal leather, wood, glass, and the like, all of which are well known in the art for their suitability for guitar pick material. In this embodiment, there is no chance of a first member becoming separated from a second member since the apparatus is formed of a monolithic piece of rigid material.

The stringed instrument plectrum apparatus 100 employs less force against and less "catch" on strings resulting in smoother playing action than a regularly held conventional pick. Said "smoother playing action or less catch" is a result of the string having a greater tendency to roll off of and release from the plectrum more readily than with a conventionally held pick. Less catching of the strings results in a reduced chance of breaking a string and thus the ability for a user to attack the strings with a novel hyper velocity. The reduced catch and more secure grip of the stringed instrument plectrum apparatus may also enable said apparatus to be dragged back and forth across the strings of a multi-stringed instrument to easily arpeggiate rhythmically to produce a drum roll or rythmic rasqueado effect.

Figure 2B:
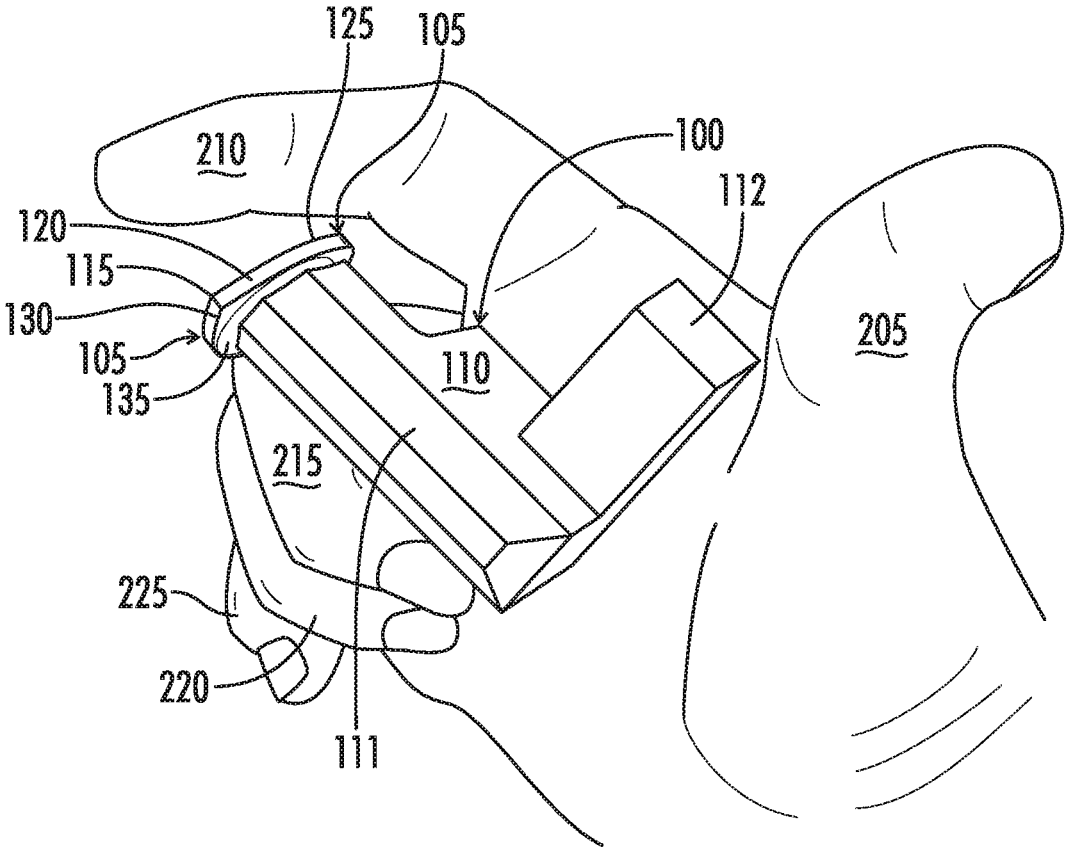
Figure 2C:
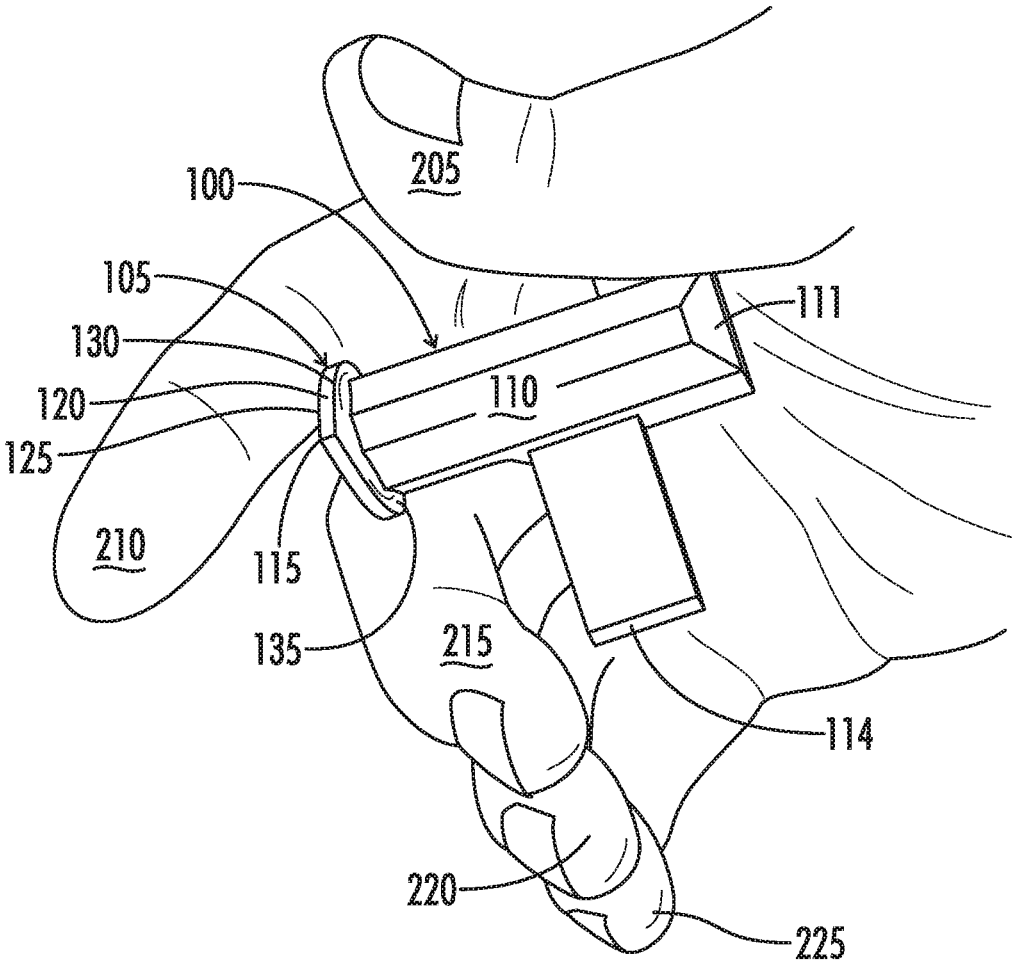

FIGS. 2A, 2B, and 2C are illustrations of the stringed instrument plectrum in a user's hand, in accordance with some embodiments.

In some embodiments, the stringed instrument plectrum apparatus 100 comprises a first member 105 and a second member 110 coupled to and extending substantially normal to a surface of a back side of the first member. The apparatus is sized so that a user playing a stringed instrument may grip the apparatus between the user's thumb 205, index finger 210, and middle finger 215. The point 115, side 120, front edge 125, back edge 130, and back surface 135 (shown in FIG. 2B and FIG. 2C) of the first member 105 of the stringed instrument plectrum apparatus comprise the playing surfaces and may be used to strike or strum one or more strings of a stringed instrument. In some embodiments, the user may use additional digits such as their ring finger 220 and pinky finger 225 to grip the handle 114. FIG. 2B shows the apparatus in the palm of the user with the thumb side of the apparatus exposed. FIG. 2C shows the apparatus in the palm of the user with the finger side of the apparatus exposed.

Figure 3:
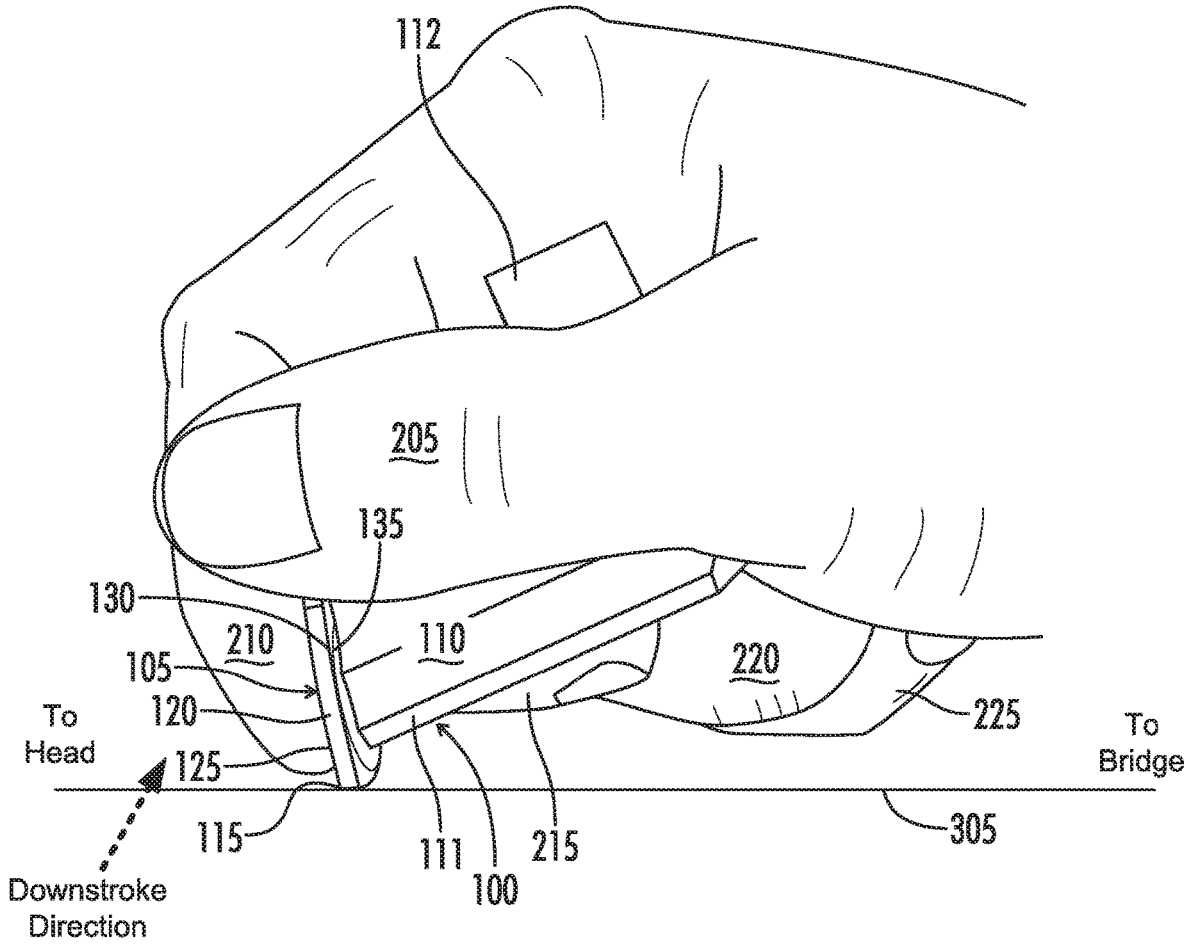
FIG. 3 is an illustration of the stringed instrument plectrum in a user's hand in a typical downstroke, in accordance with some embodiments.

FIG. 3 is an illustration of the stringed instrument plectrum in a user's hand in a typical downstroke, in accordance with some embodiments.

In some embodiments, the stringed instrument plectrum apparatus 100 comprises a first member 105 and a second member 110 coupled to and extending substantially normal to a portion of a surface of a back side of the first member. The second member 110 comprises a main body, coupled to and extending from a portion of the back surface of the first member, and two handle members extending from opposite sides of the main body. The handles of the apparatus allow for a more secure grip of the first member compared to gripping a regular pick since the apparatus involves the use of the index finger valley, thenar, upper palm, and phalanx areas of the inside of the hand as opposed to a regular pick which is held with the thumb and index finger. The handles orient the side of the first member to be the primary string playing or attack surface. The back and edges of the first member are also important playing surfaces. The first handle member 112 provides a grip between the thumb 205 and index finger 210 and the second handle provides a grip between the middle finger 215, ring finger 220, and/or pinky finger 225 and upper palm. The apparatus is sized so that a user playing a stringed instrument may grip the apparatus between the user's thumb 205 and index finger 210 and middle finger 215 and upper palm. The point 115, side 120, front edge 125, back edge 130, and back surface 135 of the first member 105 may be used to strike or strum the strings 305 of a stringed instrument. One end of the strings 305 is connected at the head and the other end is connected at the bridge. In a downstroke for playing a guitar, a user moves the playing surfaces of the apparatus against one or more of the strings in a downward motion (in the direction of the dashed arrow) to cause the strings to vibrate. In the typical downstroke, the side 120 closest to the middle finger 215 hits the strings 305. Often, especially when arpeggiating, the apparatus is tilted towards the side of the middle finger 215 on the downstroke. The second member 110 provides secure grip and control to the user enabling them to play the stringed instrument with the desired tone, volume, and speed.

Figure 4:
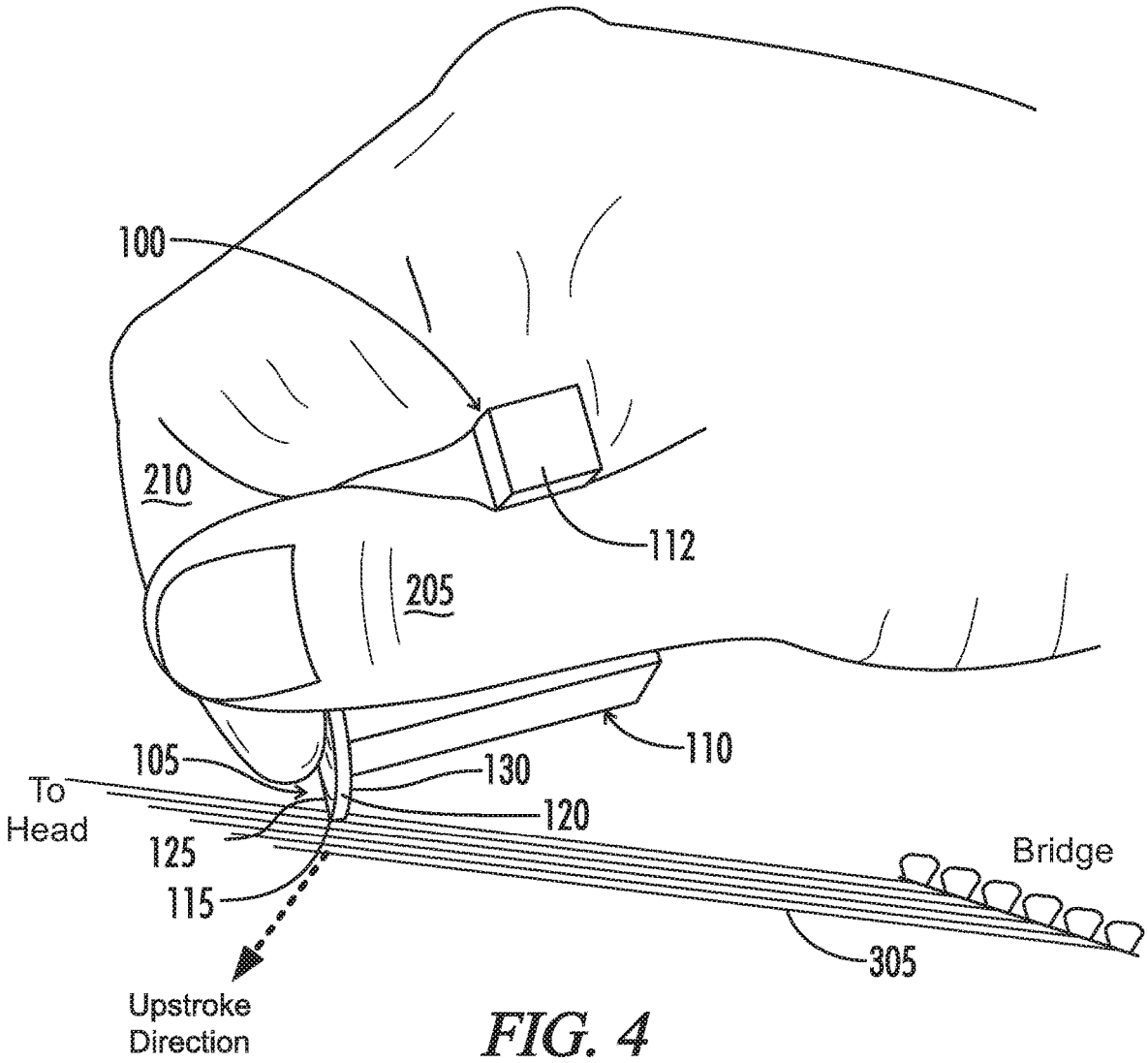
FIG. 4 is an illustration of the stringed instrument plectrum in a user's hand in a typical upstroke, in accordance with some embodiments.

FIG. 4 is an illustration of the stringed instrument plectrum in a user's hand in a typical upstroke, in accordance with some embodiments.

In some embodiments, the stringed instrument plectrum apparatus 100 comprises a first member 105 and a second member 110 coupled to and extending substantially normal to a portion of a surface of a back side of the first member. The second member 110 comprises a main body, coupled to and extending from a portion of the back side of the first member, and two handle members extending from opposite sides of the main body. The handles of the apparatus allow for a more secure grip of the first member compared to gripping a regular pick since the apparatus involves the use of the index finger valley, thenar, upper palm, and phalanx areas of the inside of the hand as opposed to a regular pick which is held with the thumb and index finger. The handles orient the side of the first member to be the primary string playing or attack surface. The back surface of the first member is also an important playing surface. The first handle member 112 provides a grip between the thumb and index finger 210 and the second handle provides a grip for the middle finger 215, ring finger 220, and/or pinky finger 225 and upper palm. The apparatus is sized so that a user playing a stringed instrument may grip the apparatus between the user's thumb 205, index finger 210, and middle finger. The point 115, side 120, front edge 125, back edge 130, and back surface 135 of the first member 105 may be used to strike or strum the strings 305 of a stringed instrument. One end of the strings 305 is connected at the head and the other end is connected at the bridge. In an upstroke for playing a guitar, a user moves the playing surfaces of the apparatus against one or more of the strings in an upward motion (in the direction of the dashed arrow) to cause the strings to vibrate. In the typical upstroke, the side, front edge, and/or back edge closest to the thumb 205 hit the strings 305. Often, especially when arpeggiating, the apparatus is tilted towards the side of the thumb 205 on the upstroke. The second member 110 provides secure grip and control to the user enabling them to play the stringed instrument with the desired tone, volume, and speed.

Figure 5:
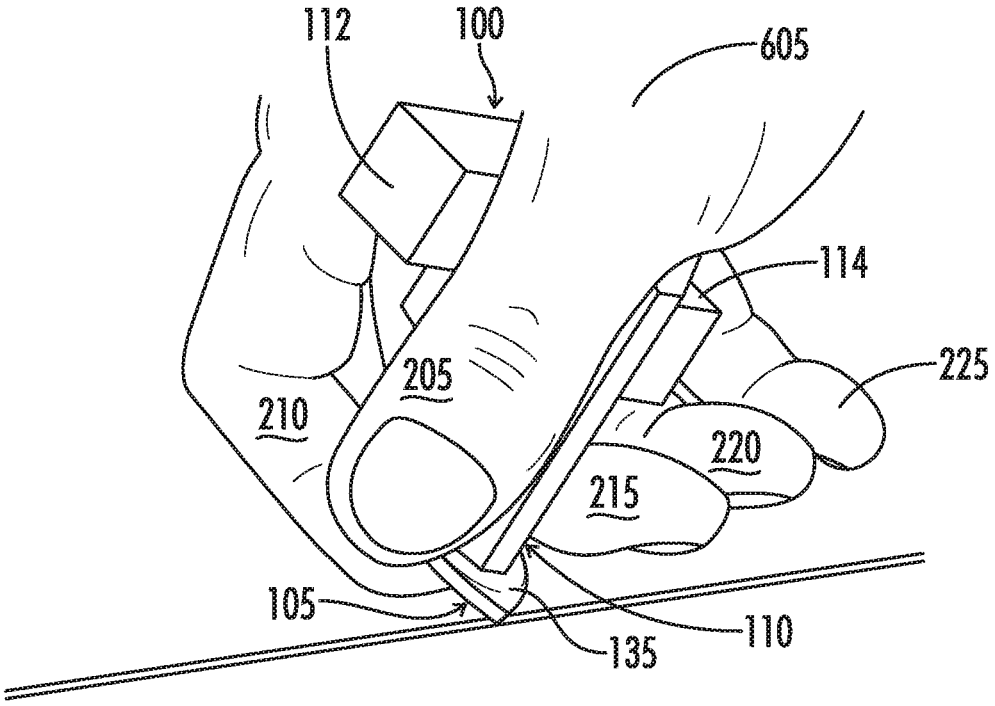
FIG. 5 is an illustration of the stringed instrument plectrum in a user's hand in a loosely held playing position, in accordance with some embodiments.

FIG. 5 is an illustration of the stringed instrument plectrum in a user's hand in a loosely held playing position, in accordance with some embodiments.

In some embodiments, as illustrated in FIG. 5, the stringed instrument plectrum apparatus 100 may be loosely held by resting the apparatus within the natural curvature of the thenar and phalanx area of the inside of a user's hand 605. In such a position, the thumb 205 loosely grasps the first handle 112 of the second member 110 against the index finger 210, the index finger 210 may rest on top of the first member 105, and the upper palm, middle finger 215, ring finger 220, and/or pinky finger 225 are used to cradle the second handle 114. This loose grip of the stringed instrument plectrum allows the user to strum with less tension in comparison to a conventional pick.

Figure 6:
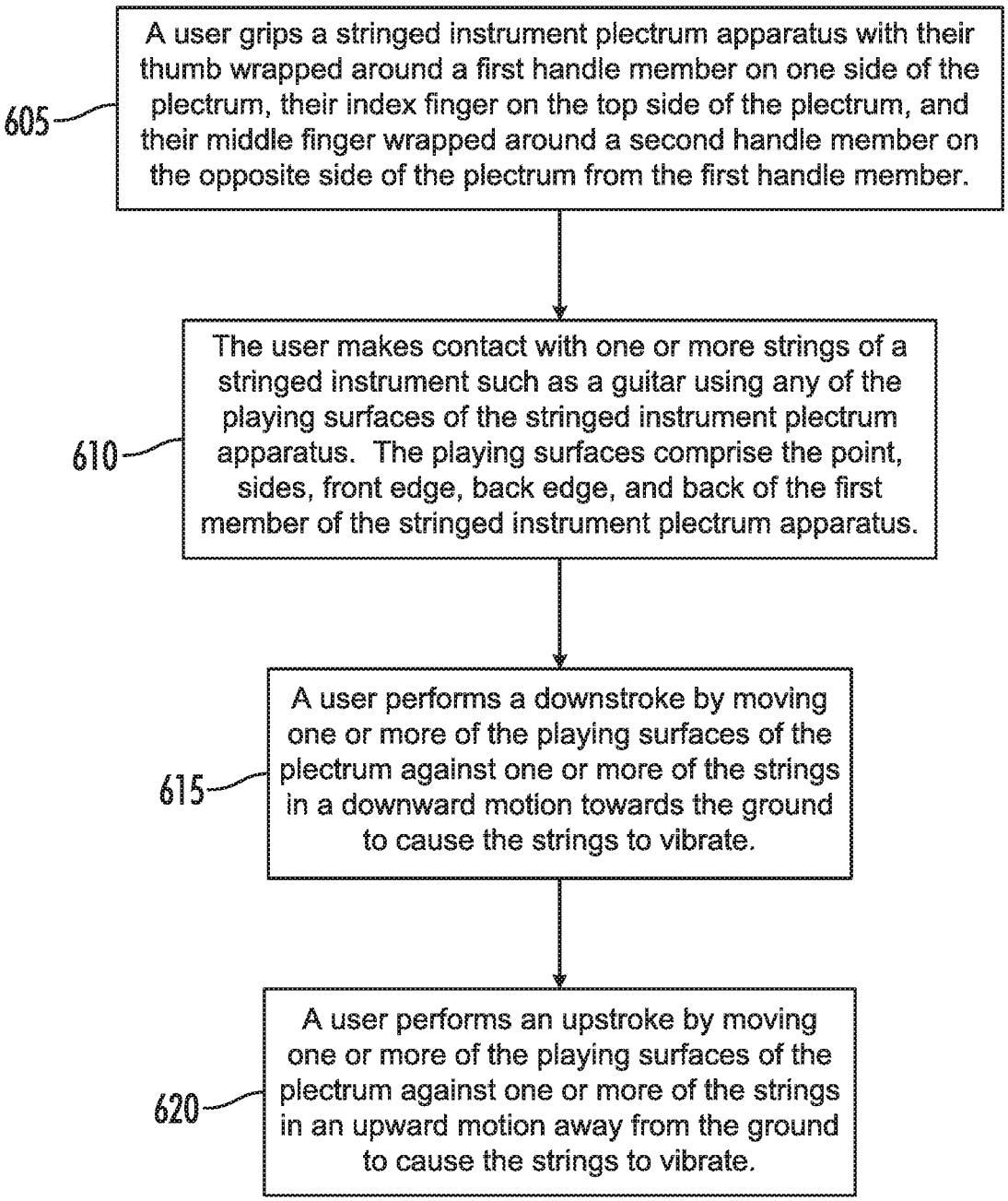
FIG. 6 is a flowchart illustrating a method for using the stringed instrument plectrum illustrated in FIGS. 1A, 1B, 2A, 2B, 2C, 3, 4, and 5, in accordance with some embodiments.

FIG. 6 is a flowchart illustrating a method for using the stringed instrument plectrum illustrated in FIGS. 1A, 1B, 2A, 2B, 2C, 3, 4, and 5, in accordance with some embodiments.

According to one embodiment of the present invention, the method begins at block 605, where, the user grips a stringed instrument plectrum apparatus with their index finger and thumb wrapped around a first handle member on one side of the plectrum, their index finger on the top side of the plectrum, and their middle finger, ring finger, and upper palm wrapped around a second handle member on the opposite side of the plectrum from the first handle member, as illustrated in FIG. 2A. At block 610, the user makes contact with one or more strings of a stringed instrument such as a guitar using any of the playing surfaces of the stringed instrument plectrum apparatus. The playing surfaces comprise the point, side, front edge, back edge, and back surface of the first member of the stringed instrument plectrum apparatus. At block 615, a user performs a downstroke by moving one or more of the playing surfaces of the plectrum against one or more of the strings in a downward motion towards the ground to cause the strings to vibrate. In the typical downstroke, the side of the plectrum closest to the middle finger hits the strings. Often, especially when arpeggiating, the plectrum is tilted towards the side of the middle finger on the downstroke. At block 620, a user performs an upstroke by moving one or more of the playing surfaces of the plectrum against one or more of the strings in an upward motion away from the ground to cause the strings to vibrate. In the typical upstroke, the side of the plectrum closest to the thumb hits the strings. Often, especially when arpeggiating, the plectrum is tilted towards the side of the thumb on the upstroke.

Figure 7:
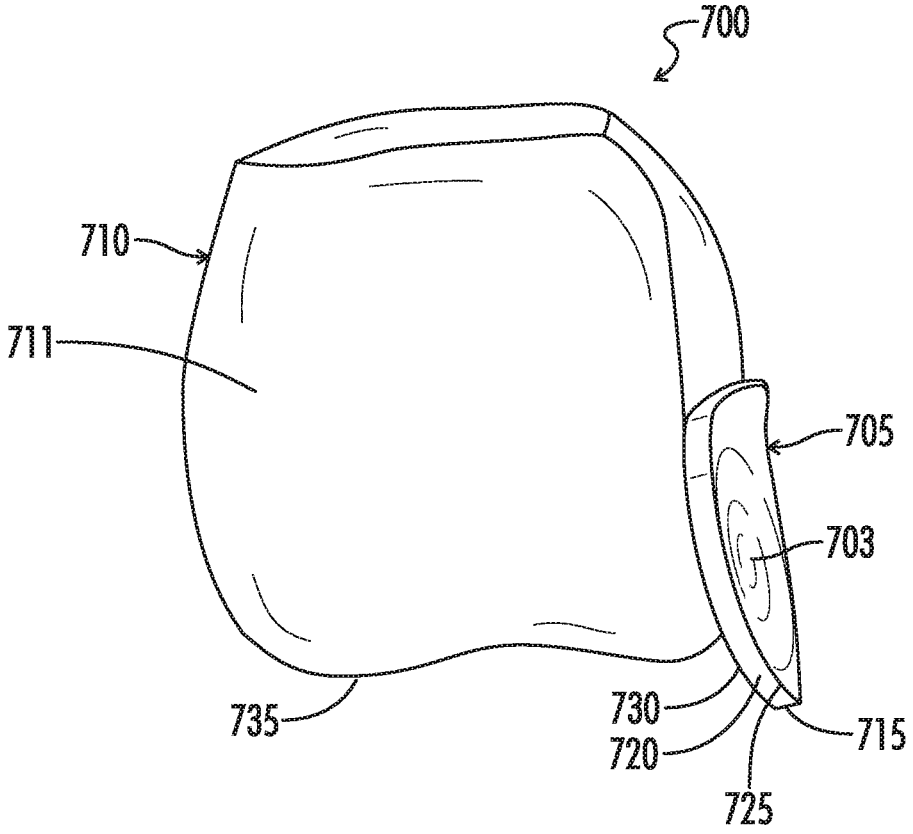
FIG. 7 is an illustration of a stringed instrument plectrum, in accordance with some embodiments.

FIG. 7 is an illustration of a stringed instrument plectrum, in accordance with some embodiments.

In some embodiments, the apparatus 700 comprises a first member 705 and a second member 710 coupled to and extending substantially normal to a portion of a surface of a back side of the first member. The first member 705 comprising a front surface 703, a point 715, a side 720, a front edge 725, a back edge 730, and a back surface. The second member 710 comprises a main body 711, coupled to and extending from a portion of the back surface of the first member. The apparatus is sized so that a user playing a stringed instrument may grip the apparatus between the user's thumb, index finger, and middle finger. The point 715, side 720, front edge 725, back edge 730, and back surface of the first member 705 as well as the protruding portion 735 of the second member 710 may be used to strike or strum one or more strings of a stringed instrument.

In some embodiments, the first member 705 is formed of a monolithic piece of material, such as (but not limited to) plastic, metal, animal horn, animal bone, animal leather, wood, glass, and the like, all of which are well known in the art for their suitability for guitar pick material. The first member 705 may comprise a substantially flat plectrum style guitar pick or have a convex shape where the perimeter (formed from the side, front edge, and back edge of the first member) of the first member curves or extends away, i.e. outward, from the second member. The convex shaped first member may be formed by cutting out a triangularly shaped portion from a surface of a sphere or other structure having a convex shape portion. In some embodiments, the second member 710 is formed of a monolithic piece of material, such as (but not limited to) foam, metal, plastic, animal horn, animal bone, animal leather, wood, glass, and the like, all of which are well known in the art for their suitability for handle or grip material.

Alternatively, in some embodiments, the first member and second member are monolithically formed as an integral unit. In such an embodiment, the apparatus 700 is formed of a monolithic piece of rigid material, such as (but not limited to) metal, plastic, animal horn, animal bone, animal leather, wood, glass, and the like, all of which are well known in the art for their suitability for guitar pick material. In this embodiment, there is no chance of a first member becoming separated from a second member since the apparatus is formed of a monolithic piece of rigid material.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

The benefits and advantages that may be provided by the present invention have been described above with regard to specific embodiments. These benefits and advantages, and any elements or limitations that may cause them to occur or to become more pronounced are not to be construed as critical, required, or essential features of any or all of the claims. As used herein, the terms "comprises," "comprising," or any other variations thereof, are intended to be interpreted as non-exclusively including the elements or limitations which follow those terms. Accordingly, a system, method, or other embodiment that comprises a set of elements is not limited to only those elements, and may include other elements not expressly listed or inherent to the claimed embodiment.

While the present invention has been described with reference to particular embodiments, it should be understood that the embodiments are illustrative and that the scope of the invention is not limited to these embodiments. Many variations, modifications, additions, and improvements to the embodiments described above are possible. It is contemplated that these variations, modifications, additions, and improvements fall within the scope of the invention as detailed within the following claims.

The invention claimed is:

1. An apparatus for playing a stringed instrument comprising:

a first member comprising a front surface, a point, a side, a front edge, a rear edge, and a back surface; and a second member comprising a main body, wherein the main body is coupled to and extends from a portion of the back surface of the first member;

wherein the front surface, the point, the side, the front edge, the rear edge, and the back surface are configured to strike or strum one or more strings of the stringed instrument.

2. The apparatus of claim 1, the second member further comprising a first handle extending from the main body and a second handle extending from an opposite side of the main body from the first handle, wherein the first handle is configured to be gripped between a thumb and an index finger and wherein the second handle is configured to be gripped with a middle finger, a ring finger, and/or a pinky finger.

3. The apparatus of claim 1, wherein the first member is substantially flat shaped.

4. The apparatus of claim 1, wherein the first member is convex-shaped.

5. The apparatus of claim 4, wherein the first member curves outward from the second member.

6. The apparatus of claim 1, wherein the first member and the second member are monolithically formed as an integral unit.

7. The apparatus of claim 1, wherein a material of the first member comprises at least one of a plastic, a metal, an animal horn, an animal bone, an animal leather, a wood, and a glass.

8. The apparatus of claim 1, wherein a material of the second member comprises at least one of a plastic, a metal, an animal horn, an animal bone, an animal leather, a wood, and a glass.

9. A method for playing a stringed instrument comprising:

providing an apparatus comprising:

a first member comprising a front surface, a point, a side, a front edge, a rear edge, and a back surface; and a second member comprising:

a main body, wherein the main body is coupled to and extends from a portion of the back surface of the first member;

a first handle extending from the main body, wherein the first handle is configured to be gripped between a thumb and an index finger; and a second handle extending from an opposite side of the main body from the first handle, wherein the second handle is configured to be gripped with a middle finger, a ring finger, and/or a pinky finger;

wherein the front surface, the point, the side, the front edge, the rear edge, and the back surface are configured to strike or strum one or more strings of the stringed instrument;

gripping the first handle between the thumb and the index finger;

gripping the second handle with the middle finger, the ring finger, and/or pinky finger; and striking or strumming the one or more strings of the stringed instrument with the front surface, the point, the side, the front edge, the rear edge, and/or the back surface of the first member to cause the strings to vibrate.

10. The method of claim 9, wherein the first member is substantially flat shaped.

11. The method of claim 9, wherein the first member is convex-shaped.

12. The method of claim 11, wherein the first member curves outward from the second member.

13. The method of claim 9, wherein the first member and the second member are monolithically formed as an integral unit.

14. The method of claim 9, wherein a material of the first member comprises at least one of a plastic, a metal, an animal horn, an animal bone, an animal leather, a wood, and a glass.

15. The method of claim 9, wherein a material of the second member comprises at least one of a plastic, a metal, an animal horn, an animal bone, an animal leather, a wood, and a glass.

* * * * *